United States Patent [19]

Cogswell et al.

[11] Patent Number: 4,796,553

[45] Date of Patent: Jan. 10, 1989

[54] FLAG DEVICE SUCH AS A DIVE FLAG DEVICE AND FLOATS FOR USE THEREWITH

[76] Inventors: Sarah L. Cogswell; Frederick R. Edington, II, both of No. 8 Sunset Ct., Avenue D, Marathon, Fla. 33050

[21] Appl. No.: 935,821

[22] Filed: Nov. 28, 1986

[51] Int. Cl.[4] ..... G09F 17/00

[52] U.S. Cl. ..... 116/173; 116/174; 116/209

[58] Field of Search ..... 116/28 R, 173–175, 116/209; 114/326, 329, 267; 441/1, 6, 11; 40/591, 592, 602, 218, 326; 248/521

[56] References Cited

U.S. PATENT DOCUMENTS

| | | | |
|---|---|---|---|
| 174,866 | 3/1876 | Smith | 73/188 |
| 433,124 | 7/1890 | Hall | 248/156 |
| 3,089,156 | 5/1963 | Hamm | 116/209 |
| 3,105,459 | 10/1963 | Conn | 116/209 |
| 3,107,648 | 10/1963 | Lundstrom | 116/173 |
| 3,127,869 | 4/1964 | Howland | 116/173 |
| 3,162,409 | 12/1964 | Straayer et al. | 116/173 |
| 3,193,855 | 7/1965 | Chapman | 114/267 |
| 3,204,599 | 9/1965 | Milosch | 116/209 |
| 3,280,789 | 10/1966 | Lewis et al. | 116/173 |
| 3,280,790 | 10/1966 | Booth | 116/173 |
| 3,526,050 | 9/1970 | Weller | 40/591 |
| 3,648,957 | 3/1972 | Bencriscutto | 248/521 |
| 3,760,441 | 9/1973 | Handelman | 116/173 |
| 3,903,629 | 9/1975 | Gruna | 40/591 |
| 4,035,856 | 7/1977 | Oberg | 116/209 |
| 4,123,813 | 11/1978 | Adams | 116/173 |
| 4,144,606 | 3/1979 | McIntyre | 441/11 |
| 4,312,089 | 1/1982 | Taylor | 114/267 |

FOREIGN PATENT DOCUMENTS

| | | | |
|---|---|---|---|
| 202478 | 10/1908 | Fed. Rep. of Germany | 441/11 |
| 90515 | 10/1957 | Norway | 441/11 |

*Primary Examiner*—William A. Cuchlinski, Jr.
*Assistant Examiner*—W. Morris Worth
*Attorney, Agent, or Firm*—Haverstock, Garrett & Roberts

[57] ABSTRACT

A flag device constructed of a foam or foam-like plastic material of sufficient thickness and strength to be able to stand out in a substantially horizontal condition when supported along one side edge without collapsing. The invention also resides in a novel support structure for the subject flag including an elongated member to which the flag is attached. The support structure may include a novel buoyant structure with a rod extending therethrough, one end of the rod having a weight attached thereto and the opposite end adapted for attaching a flag thereto.

24 Claims, 3 Drawing Sheets

FLAG DEVICE SUCH AS A DIVE FLAG DEVICE AND FLOATS FOR USE THEREWITH

BACKGROUND OF THE INVENTION

There exists a need for a flag device such as a dive flag that will remain extended at all times and perform various functions including as a warning device such as to identify the location where a diver is operating. Such a flag will remain relatively rigid and therefore highly visable under all conditions including under calm as well as during windy conditions. One of the problems with known flags including those used for the same and similar purposes is that they are for the most part constructed of a fabric or cloth-like material so that they hang limp under calm wind conditions and flap and flutter in the wind. Under both conditions the known flags are difficult to see especially from certain directions and at a distance. This is highly undesirable especially in areas where there may be considerable boating activity and where it is important to indicate where a diver is operating underwater so that boats and other vessels and water skiers in the area, and especially those traveling at relatively high speeds, will be able to see the flag in time to avoid the area. It is also important that flags of this nature be able to rotate with the wind to provide maximum visability and to indicate wind direction. There also exists a need for an improved float device for use with the subject flags, including a float device that is easy to install and use and one that does not become water-logged and will provide support for a swimmer including a swimmer equipped with snorkeling gear.

SUMMARY OF THE INVENTION

The present invention resides in a relatively rigid flag device preferably constructed of a foam or foam-like plastic material of sufficient thickness and strength to be able to extend outwardly in a substantially vertical condition from a mounting member without collapsing. It is also important to be able to mount the subject flags to a support member such as to a vertical support member in such a way that it is able to rotate in the wind, and so that the flags can be attached and detached from the support member in a relatively simple and easy manner. Flags of this type are especially useful as warning devices such as to indicate the location where a diver is operating underwater. Floats for the subject device are constructed of a material such as highly compressed Styrofoam (a registered trademark of Dow Chemical Co.) so that they resists taking on water when afloat and yet are able to provide support for rod assemblies that have weights at one end and rod portions on the opposite upper ends that can be used to attach a flag.

It is a principal object of the present invention to provide an improved flag construction and particularly a flag construction for use in identifying the location where a diver or other person is operating underwater, which flag is able to stand out and be seen under substantially all conditions.

Another object is to teach the construction of a relatively simple yet highly effective flag.

Another object is to teach the construction of a relatively rigid flag fabricated of a foam or foam-like plastic material.

Another object is to improve the safety environment for divers and other persons and objects located or operating on and under water.

Another object is to provide a highly visible warning that somebody is operating on or under water.

Another object is to provide an attractive flag which can be relatively easily mounted on boats, buoys, and other places.

Another object is to provide a relatively rigid flag member having opposed relatively smooth surfaces on which it is possible to silkscreen, print, or otherwise form desired images and designs.

Another object is to teach the construction of a flag device which is relatively easy to install on and take down from an existing structure.

Another object is to teach the construction of a flag device that can be rolled up into a relatively compact form for storage and handling.

Another object is to teach the construction and assembly of a float or buoy device that can be used to support a flag such as a dive flag.

Another object is to teach the construction of a float device that can be used to support a swimmer, including a swimmer equipped with snorkeling gear, for extended periods and without becoming water-logged.

Another object is to teach the construction of a float device that has few parts and is relatively easy to construct, assemble and use.

These and other objects and advantages of the present invention will become apparent to those skilled in the art after considering the following detailed specification in conjunction with the accompanying drawings wherein:

DETAILED DESCRIPTION OF THE DRAWINGS

Figure 1:
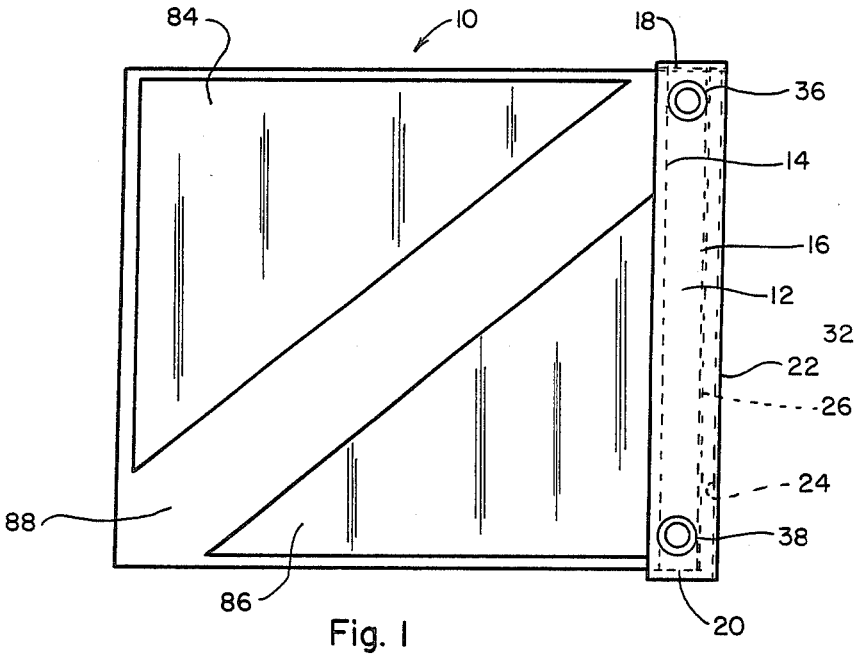
FIG. 1 is a side elevational view of a flag such as a dive flag constructed according to the teachings of the present invention.
Figure 1A:
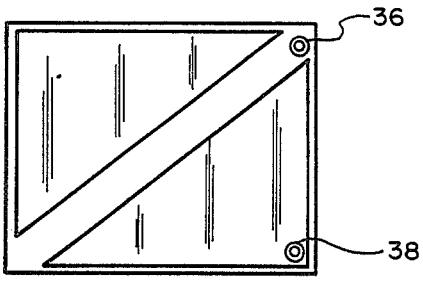
FIG. 1A shows a somewhat simplified version of the flag shown in FIG. 1.

Referring to the drawings more particularly by reference numbers, numbers 10 in FIG. 1 and 10A in FIG. 1A refer to a flag constructed according to the teachings of the present invention. The flags can be formed as a plain sheet of foam plastic and it may optionally have a band 12 of marine vinyl or similar material sewn or stitched thereto as will be more fully explained hereinafter. No such band is necessary for the flag 10A shown in FIG. 1A although this construction otherwise is similar and operates similarly. The dimensions of the subject flag are selected based on the purpose for which it will be used. A typical size for the flag when used as a dive flag is about 16 inches by about 14 inches with a thickness of approximately ¼ inch. Other sizes and shapes are also possible including both larger and smaller sizes and shapes as well as different thicknesses.

The subject flag is preferably constructed of a foam or foam-like material such as of polyethelene or polyurethane foam, and during construction sufficient pressure should be applied during formation so that the opposite surfaces are as smooth as possible. This is desirable so that a pattern or message can be securely formed thereon as by being silkscreened, printed, painted or otherwise applied. The desired pattern or design is usually applied to both opposite surfaces so that when the flag is used its message can be seen from most directions. A flag so constructed requires no special stiffener means to hold it out, and it is preferable, as will be explained, to mount the subject flag so that it can rotate freely and with minimal fluttering and flapping. By being relatively stiff and having highly visible coloring, the present flags are easy to see even at great distances, they do not fray, they are lightweight and buoyant and they do not catch the wind as much as a cloth flag. This also means that they do not put as much pressure on the mounting means to which they are attached. Still further, should one of the subject flags come loose from its mounting for some reason and fall into the water, it will float and therefore is relatively easy to find and retrieve.

The band 12 is approximately of the same length as the height of the flag 10, is made of a material such as marine vinyl and is shown stitched through the flag 10 along parallel stitch lines 14, 16, 18, and 20. The upper stitching 18 also extends to the fold edge 22 of the band 12 to form a passage 24 defined by the fold portion 22 of the band 12 and the adjacent side edge 26 of the flag 10.

It is preferred that the subject flag be mounted on a rod such as a fiberglass rod 28 (FIG. 4), which has its lower end mounted by inserting it extending into a tubular support member 30. A typical rod 28 for this purpose may be formed of fiberglass, steel or other suitable material, and the tube 30 (made of PVC or similar material) into which the rod is installed can be mounted in many different places including being mounted on a boat, a dock, another vehicle or other suitable location. The rod 28 can also have a fitting on one end for cooperation with a mating fitting on a support member as will be explained hereinafter. The rod 28 is typically about four feet (4') long and the subject flags can be attached thereto by sliding the rod 28 into the passage 24 until the end of the rod 28 is stopped by the cross-stitching 18. The flags can also be attached to a rigging cord or halyard as will be described including by using plastic or other type ties, such as twist ties, pipe cleaners or similar devices. The subject flag can also be attached to a vertical member or staff on a buoy or float device as will be described.

During the formation of the foam plastic used in making the subject flags, it is highly desirable to use sufficient pressure during formation to cause the opposite surfaces or skins 32 and 34 (FIG. 2) of the foam plastic used to be as smooth as possible. By being smooth, the skin or skin-like surfaces are better able to have images applied to them as by silkscreening, printing or painting including by spray painting. Designs so applied usually adhere better and are easier to apply to a smooth than to a rough surface, and when so applied will be better able to stand up without deteriorating even under severe environmental conditions such as under prolonged exposure to bright sunlight, severe weather conditions and prolonged exposure to water, including to salt water.

Figure 2:
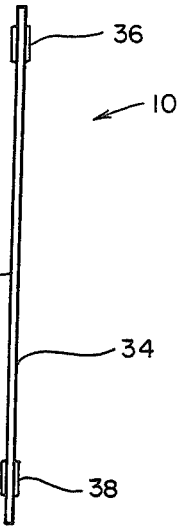
FIG. 2 is an edge view of the same flag.

Adjacent to one side edge of the flag 10 including the side to which the band 12 is attached in FIG. 1 and adjacent to the corresponding side of the flag 10A in FIG. 1A, and at spaced locations near the upper and lower corners thereof as shown in FIGS. 1 and 2 are located spaced grommets 36 and 38. The size of the grommets 36 and 38 is selected as desired since the grommets are mostly for cooperating with wrap ties or like members such as with the wrap ties 40 used for attaching the flag 10 to the support member or rod 28. The grommets 36 and 38 can be used to attach the flag 10 to the support means with and without the support means being inserted into the passage 24 and this is especially handy when mounting the flag to a line or other member that is notable to be positioned in the passage 24. The band 12 will reinforce the grommets 36 and 38 and make the flags more tear resistant.

Figure 3:
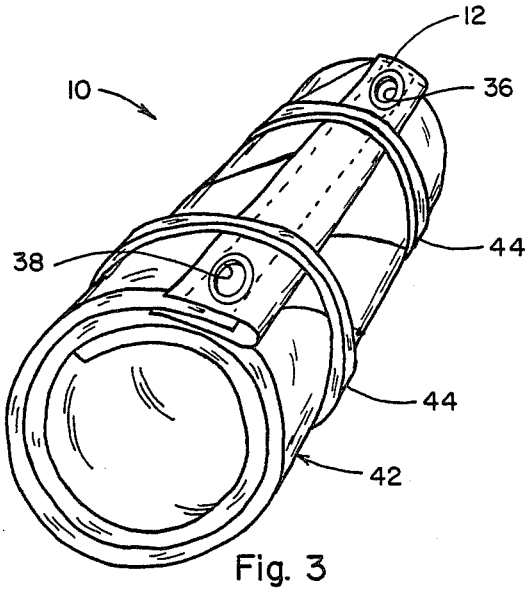
FIG. 3 shows the subject flag rolled up for storage in a relatively small space.

FIG. 3 shows the subject flag 10 rolled up into a relatively compact cylinder 42 for storage or mailing as desired. In this condition the flag can also be packaged in a suitable container or maintained folded by means such as strings, rubber bands or like devices 44.

Figure 4:
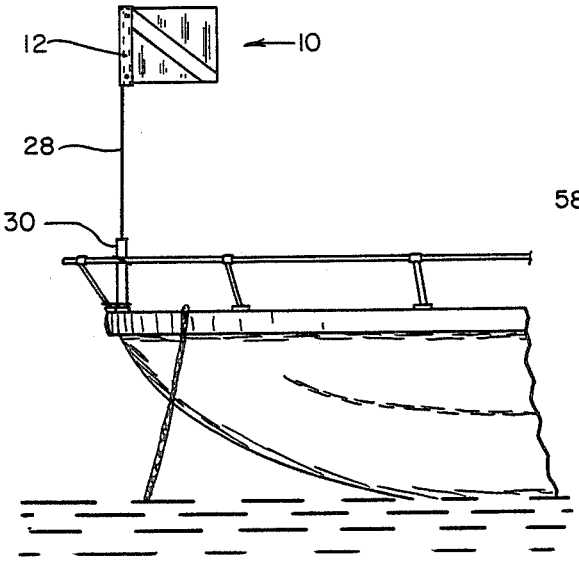
FIG. 4 shows the subject flag mounted on a flagstaff attached to a boat.

In FIG. 4 the flag 10 is shown attached to the upper end of the rod member 28 which has its lower end mounted in the tubular support or socket member 30. In this construction, the rod 28 and the socket 30 are both constructed of relatively rigid materials such as of metals or plastics, polyvinyl choloride (PVC) being a good selection for the socket 30 and fiberglass for the rod 28. It is preferred that the rod member 28 be able to rotate relatively freely in the socket member 30 so that when the flag is mounted the wind will cause the flag 10 to assume a downwind oriented position. This reduces wind friction against the flag 10 and also reduces the force of the flag on the support member 28 and on the socket member 30. Unlike more conventional cloth flags, however, the flag 10 is not as able to flap and flutter in the wind, and therefore is not as likely to fray or tear. While not being as able to flap or flutter, the flag 10 nevertheless is able to maintain its outwardly extending fully visible condition at all times. This is especially important for flags used to alert persons that they should avoid coming too close.

While the present flag construction has been found to be especially useful as a dive flag, it can also be used in the construction of other types of flags and pennants as well. For example, as stated above, it is possible to make the subject flag of different sizes, shapes and thicknesses, and it is possible to have different designs silkscreened, printed, painted or otherwise formed on one or both opposite surfaces depending on the purpose for which it is to be used. It is to be understood therefore that flags of the present construction can be used for many different purposes and are not limited to use as dive flags. For example, it is expected that some of the subject flags will be constructed in somewhat smaller sizes for use on smaller vessels and for mounting on buoys and the like, and in somewhat larger sizes, even up to a square meter or larger and with greater thicknesses, where they are to be used for other purposes such as with commercial diving operations and on larger vessels and ships.

It has been found that flags constructed according to the present invention, that have colors and designs applied by a silkscreening process, retain their colors without fading or deteriorating for longer periods than is true of cloth or fabric flags, and this is especially important where the flags are to be used in the bright sun and/or are exposed to salt water. Also, by being relatively rigid so that they do not flap and flutter the subject flags are less likely to tear or fray as aforesaid. It has been found during actual usage that the subject flags do relatively little fluttering and flapping at wind speeds up to about 40 miles per hour, and this more than covers the range of wind speeds that would normally be expected to be encountered where diving or other workman activities are going on.

Figure 5:
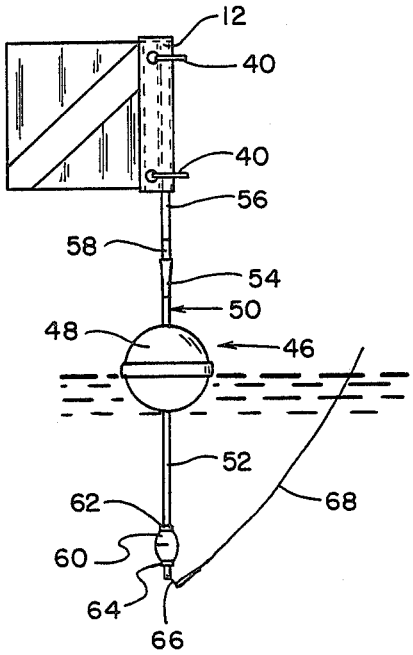
FIG. 5 shows the subject flag mounted on a float or buoy.
Figure 7:
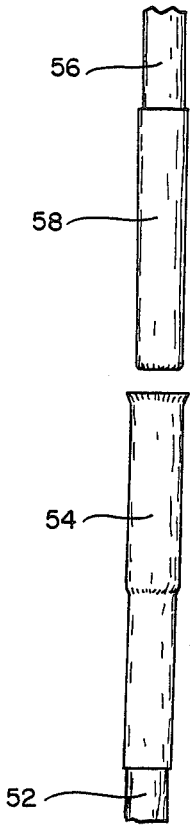
FIG. 7 is an enlarged fragmentary view showing male and female connector means used to connect the portion of the float of FIG. 5 together.

FIG. 5 shows one of the subject flags 10 mounted on a float or buoy 46. The float 46 includes a buoyant body 48 with one portion of a two-piece rod assembly 50 extending therethrough and from both opposite sides. The rod assembly 50 has a lower rod portion 52 which extends through the body 48 and is shown having a female fitting 54 (FIGS. 5 and 7) formed of a material such as stainless steel attached to one end (the upper end) thereof. The rod assembly 50 also includes an upper rod portion 56 which has a stainless steel male fitting 58 attached to the lower end thereof. The fittings 54 and 58 cooperate when pressed one into the other to form a snug connection therebetween.

The lower end of the lower rod portion 52 extends from the body 48 of the float 46 and a weight member 60 is mounted on the rod portion 52 near its free lower end. The size of the weight 40 is selected to be large enough to maintain the rod assembly 50 in vertical or near vertical orientation with the flag clearly visible when the device is floating on water. The weight 40 can be held in position on the rod portion 52 by washers 62 and 64 (FIG. 5) which are relatively tight fitting or even adhesively attached to the rod portion 52. The lower rod portion 52 also has a hole through it beyond the lower end of the weight 60 to accommodate a metal ring 66 to which is attached one end of a tether cord 68. The opposite end of the cord 68 can be attached to a boat, a dock or to some other structure to which the float 46 is to be tethered.

Figure 6:
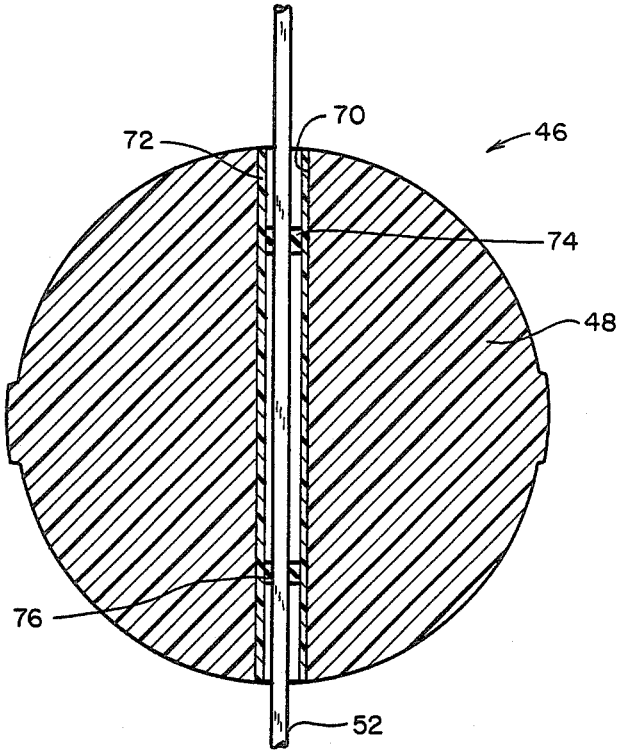
FIG. 6 is an enlarged fragmentary cross-sectional view taken through the center of the float of FIG. 5.

More of the details of the construction of the float 46 are shown in FIG. 6 wherein the body 58 is shown having a bore 70 therethrough that fixedly receives a tubular member 72. The body 58 is preferably constructed of relatively highly compressed Styrofoam similar to what is used in the contruction of lobster buoys and like devices thereby enabling it to float relatively high on the water for its size taking into account the size of the weight 60. This makes its buoyancy better than that of more conventional floats such as those having cylindrical shaped bodies and constructed of open-celled plastic foam. The open-celled plastic foams used heretofore are not as buoyant, do not float as well and are more easily overturned in the wind than compressed Styrofoam floats, and they also take on water and in time become waterlogged. The compressed Styrofoam used in the bodies of the subject floats may be made to have various shapes including the round and oblong shapes shown, and the floats disclosed herein are very easy to assemble even at the site where they are to be used. One portion of the subject float includes the compressed Styrofoam body 48 with the tubular member 72 therethrough and with the lower rod portion 52 extending therefrom. The rod portion 52 can be adhesively or otherwise made secure in the plastic tube 72 so that the rod 52 becomes a fixed part of the body 58. In the float shown in FIG. 6, the rod portion 52 is shown extending through spaced oversize resilient ring members 74 and 76 which maintain tight fitting engagement therebetween. The upper end of the rod member 52 has the female fitting 54, described above attached to it for cooperation with the male fitting 58 on the upper rod member 56.

The construction and assembly of the float 46 is simple and represents an important improvement over floats used heretofore, including known cylindrical shaped floats formed of open-celled plastic foam. Also, known type floats are more adversely affected by the action of the wind and the waves than the present float and tend to tip over more easily. When this happens, the flag mounted thereon, which heretofore has been a cloth-type flag, dips in the water and thereafter hang limp and is relatively more difficult to see. Furthermore, the known flags are usually mounted on the rod portion of the buoy by sliding a closed end tubular portion of the cloth flag over the upper end of a rod member. Such flags, without more, will work loose when repeatedly dipped in water and eventually will come loose altogether from the support member and will sink and be lost. Because of this, some of the prior art cloth dive flags have been further attached to the support means by applying clips which snug them in place on the rods. This has also been unsatisfactory in many situations because the clips have come loose and been lost. The clips also represent additional parts to keep track of.

Figure 8:
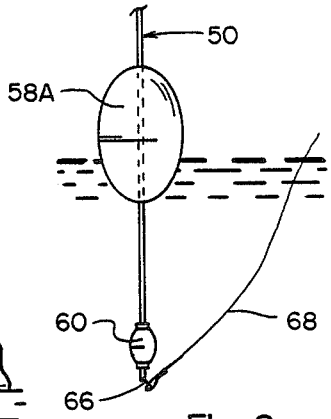
FIG. 8 is a fragmentary view showing another shape for the body of a float device; and, FIG. 9 shows the subject flag mounted on a support structure attached to an innertube.

By contrast, floats constructed according to the present invention are relatively easy to assemble and they also can be used to support a swimmer or a snorkeler should he or she become tired and require help to stay afloat. This, of course, will depend to some extent on the size of the float being used. In fact, the subject floats lend themselves to being made large enough for the intended purpose and at the same time provide sufficient buoyancy to support a swimmer or snorkeler for extending periods without waterlogging. As shown in FIG. 8, a typical larger size float might be one with an oval body 58A in the range of about seven and one-half ($7\frac{1}{2}''$) inches in diameter. Such a float is of sufficient size to keep a snorkeler or a swimmer afloat indefinitely. This is an important additional advantage of the present float construction which is not available with known floats. The smaller sizes will usually provide sufficient support for swimmers and snorkelers. The subject float construction therefore represents an important means for supporting a dive flag in an easy-to-see manner and can also serve as a safety device for those in the water.

Figure 9:
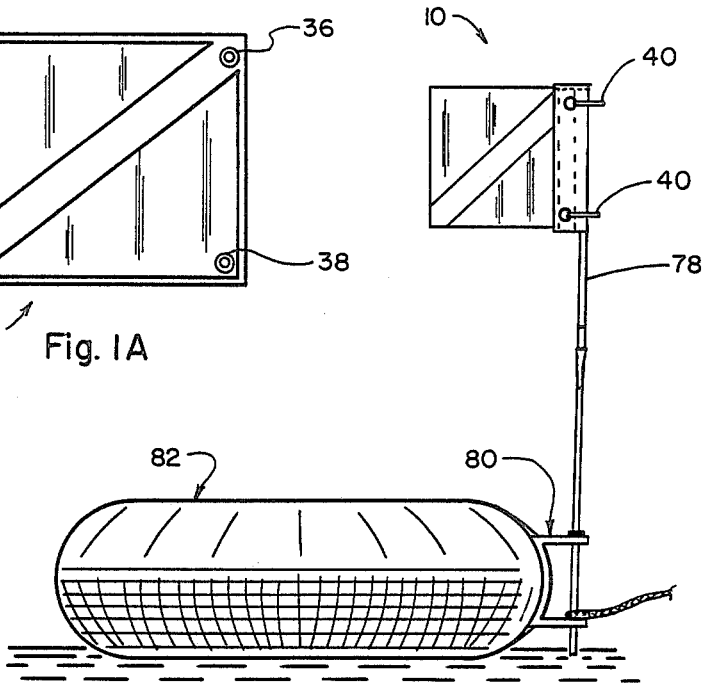

FIG. 9 shows one of the subject flags 10 mounted on the upper end of a rod member 78, the lower end of which is supported by a bracket assembly 80 attached to one side of an innertube 82. The subject flags can also be mounted on other devices and structures as well, some examples of which are identified herein.

The design applied to the surfaces 32 and 34 of the subject flat 10 depends on the message intended to be conveyed. In the United States, the design shown on the flags in FIGS. 1, 4, 5 and 9 where the areas 84 and 86 (FIG. 1) are red and the remaining areas 88 are white, is used to indicate caution because a diver is operating in the area. The design applied to both opposite sides of the design will always be the same. A somewhat different design is used for the same purpose for the international designation. Other designs and symbols can be used for other purposes including to identify businesses, political divisions, as warning flags for use by utilities and others to indicate areas of activity, as national flags, and so forth.

Thus there has been shown and described novel flag and float constructions which fulfill all of the objects and advantages sought therefor. It should be recognized, however, that the subject flag and float have many possible purposes and applications including to identify locations where divers or others are operating and as a safety device for swimmers to hold onto for rest or rescue. It will be apparent to those skilled in the art, however, that many changes, variations, modifications and other uses and applications for the subject flags and floats are possible and contemplated, and all such changes, variations, modifications and other uses and applications which do not depart from the spirit and scope of the invention are deemed to be covered by the invention which is limited only by the claims which follow.

What is claimed is:

1. A flag and means for mounting same comprising a panel formed of foam material capable of floating on water having finite thickness sufficient so that the foam material will resist bending and maintain the panel in a substantially flat unstressed condition, said panel having relatively smooth parallel spaced opposite surfaces and a plurality of side edges extending around and forming the periphery thereof, an elongated flexible cloth-like member folded midway along its length with portions located adjacent opposite sides of the panel along one side edge thereof, means attaching the cloth-like member to the panel with said cloth-like member and said one side edge of the panel forming a passageway therebetween, means blocking the passageway adjacent one end thereof, spaced attachment means attached to the panel adjacent to said one side edge, an elongated rod member having an end portion extendible into the passageway being limited by the means blocking one end thereof for mounting said panel for rotational movement, and means cooperatively engageable with the spaced attachment means on the panel including means extending around the passageway and the end portion of the rod member positioned therein adjustable to tighten the cloth-like member on the rod.

2. The flag and mounting means of claim 1 wherein a design is formed on at least one of the spaced opposite surfaces of the panel.

3. The flag and mounting means of claim 2 wherein the design is formed by silkscreening it onto at least one surface.

4. The flag and mounting means of claim 2 wherein the design is formed by printing it onto at least one surface.

5. The flag and mounting means of claim 1 wherein the elongated rod member is a fiberglass rod.

6. The flag and mounting means of claim 1 wherein the panel is flexible enough to be rolled up into a relatively compact form.

7. The flag and mounting means of claim 1 including a float device having a buoyant body with a passageway therethrough, the elongated rod member mounted extending through the passageway, a weight attached to one end of the rod member so that when the float device is floating on water, the opposite end of the elongated rod member extends upwardly from the buoyant body for mounting said panel thereon.

8. The flag and mounting means of claim 7 including means for tethering the float device, said tethering means including a cord attachment device mounted on the elongated rod member adjacent to the weight, said cord having a first end for connection to the attachment device and an opposite end for connecting to a structure to which the float device is to be tethered.

9. The flag and mounting means of claim 7 wherein the buoyant body is formed of compressed Styrofoam.

10. A flag comprising a panel formed of a foam plastic material selected from the group consisting of foam polyethylene and foam polypropylene, said panel having sufficient thickness so that the foam construction thereof is able to maintain the panel in a substantially flat unstressed condition to resist bending thereof, the panel having spaced opposite surfaces and a plurality of peripheral side edges extending therearound, the opposite surfaces of said panel having relatively smooth skin-like surface characteristics, a design formed on each of the opposite surfaces, a mounting member including a rod having a free end portion, attachment means adjacent to one side edge of the panel to facilitate mounting the panel on the free end portion of the rod for rotational movement thereon including an elongated cloth-like member foldable lengthwise and positioned to overlap an edge portion of the panel along one side edge thereof and to form a passageway along said one side edge sized to slidably receive the free end portion of the rod therein, means for attaching the cloth-like member to the panel, and means blocking the passageway adjacent one end thereof to limit movement of the rod into the passageway.

11. The flag of claim 10 wherein the design formed on the opposite surfaces of the panel are formed by being silkscreened thereon.

12. The flag of claim 10 wherein the means for attaching the cloth-like member to the panel includes stitching.

13. The flag of claim 10 wherein the cloth-like member is formed of a plastic material.

14. The flag of claim 10 including at least two spaced grommets positioned extending through the cloth-like member and through the overlapped edge portion of the panel.

15. The flag of claim 10 wherein the attachment means adjacent one side edge include at least two spaced grommets attached thereto, said grommets being adjacent opposite ends of said one side edge.

16. The flag of claim 10 wherein the rod has a portion for attaching to a support structure.

17. The flag of claim 10 including socket members for supporting the rod.

18. The flag of claim 14 including tie type fastener means engageable with the grommets to facilitate attaching the flag to the free end portion of said rod.

19. The flag of claim 10 wherein the rod includes first and second elongated portions, a male connector on one end of the first portion, and a female connector on one end of the second portion for cooperating with the male connector.

20. The flag and mounting means of claim 10 including a bracket member having means thereon for receiving and supporting the rod.

21. A flag and means for mounting same comprising a panel formed of foam material having finite thickness sufficient so that the foam material will resist bending and maintain the panel in a substantially flat unstressed condition, said panel having relatively smooth parallel spaced opposite surfaces and a plurality of side edges extending around and forming the periphery thereof, an elongated flexible cloth-like member folded midway along its length with portions located on opposite sides of the fold positioned adjacent opposite sides of the panel along and adjacent to one side edge thereof, said cloth-like member and the adjacent panel side edge defining a passageway along said one side edge, means for attaching the cloth-like member to the panel, and a pair of spaced grommets positioned extending through the cloth-like member and through the panel therebetween.

22. The flag of claim 21 including means for closing one end of the passageway formed by and between the folded portions of the cloth-like member and the adjacent one side edge of the panel.

23. The flag of claim 22 wherein the means attaching the cloth-like member to the panel and the means closing one end of the passageway includes stitching.

24. The flag for mounting on a rod member comprising a panel formed of a foam plastic material of sufficient thickness so that the foam construction thereof resists bending and is able to maintain the panel in a substantially flat unstressed condition, the panel having spaced opposite surfaces and a plurality of peripheral side edges extending therearound, means attached to the panel extending along one side edge thereof to facilitate mounting the panel on the rod member for rotational movement thereon including an elongated cloth-like member foldable lengthwise and extending along the one side edge of the panel to form a passageway therealong sized to slidably receive the rod member on which the panel is to be mounted, means for attaching the cloth-like member to the panel, and means blocking the passageway adjacent one end thereof to limit penetration of the mounting rod member into the passageway.

* * * * *

UNITED STATES PATENT OFFICE

CERTIFICATE OF CORRECTION

Patent No. 4,796,553 Dated January 10, 1989

Inventor(s) Cogswell et al

It is certified that error appears in the above-identified patent and that said Letters Patent is hereby corrected as shown below:

Column 4, line 20, "notable" should be -- not able --.

Signed and Sealed this

Sixth Day of June, 1989

*Attest:*

DONALD J. QUIGG

*Attesting Officer*

*Commissioner of Patents and Trademarks*